US005714116A

United States Patent [19]

Beguinot et al.

[11] Patent Number: 5,714,116

[45] Date of Patent: Feb. 3, 1998

[54] STEEL AND PROCESS FOR THE MANUFACTURE OF COMPONENTS HAVING HIGH ABRASION RESISTANCE

[75] Inventors: Jean Beguinot; Jean-Georges Brisson, both of Le Creusot, France

[73] Assignee: Creusot Loire Industrie (Societe Anonyme), Puteaux, France

[21] Appl. No.: 637,177

[22] Filed: Apr. 24, 1996

[30] Foreign Application Priority Data

Apr. 27, 1995 [FR] France ..... 95 05016

[51] Int. Cl.[6] ..... C22C 38/22; C22C 38/44; C21D 1/18

[52] U.S. Cl. ..... 420/105; 420/108; 420/109; 148/661; 148/654

[58] Field of Search ..... 420/108, 109, 420/105, 106, 110–111; 148/661, 662, 654, 335

[56] References Cited

U.S. PATENT DOCUMENTS 3,615,879 10/1971 Herzog .

FOREIGN PATENT DOCUMENTS

| | | | |
|---|---|---|---|
| C-4337148 | 10/1994 | Germany . | |
| 46-37253 | 11/1971 | Japan | 148/335 |
| 54-72712 | 6/1979 | Japan | 148/335 |
| 57-192247 | 11/1982 | Japan | 420/103 |
| 61-157625 | 7/1986 | Japan | 148/661 |

*Primary Examiner*—Deborah Yee
*Attorney, Agent, or Firm*—Oblon, Spivak, McClelland, Maier & Neustadt, P.C.

[57] ABSTRACT

A steel composition useful for the manufacture of articles and components having high abrasion resistance.

14 Claims, No Drawings

STEEL AND PROCESS FOR THE MANUFACTURE OF COMPONENTS HAVING HIGH ABRASION RESISTANCE

BACKGROUND OF THE INVENTION

1. Field of the Invention

The present invention relates to steels for the manufacture of components having high abrasion resistance, to components comprising these steels, and to methods of manufacturing such components.

2. Discussion of the Background

In the mining industry, equipment is used, such as chutes, sieves and cutting blades, etc., which are subjected to severe abrasive wearing. To manufacture such equipment, components, and especially sheets, are used which are made of steel having high abrasion resistance and hardened, with a hardness of between, approximately, 550 HB and 600 HB. These steels typically contain from 0.35% to 0.5% of carbon and from 0.5% to 3% of at least one alloy element, such as manganese, chromium, nickel or molybdenum. These steels have the drawback, however, of being very difficult to cut and to weld, have low formability and, in general, are brittle.

SUMMARY OF THE INVENTION

The object of the present invention is to remedy these drawbacks by providing a steel which makes it possible to manufacture components, and especially sheets, which are easy to weld and to cut, and which have an abrasion resistance comparable to that of components according to the prior art.

To this end, the invention provides a steel, the chemical composition of which comprises, by weight based on total weight:

$$0.24\% \leqq C \leqq 0.3\%$$

$$0\% \leqq Si \leqq 2\%$$

$$0\% \leqq Al \leqq 2\%$$

$$0\% \leqq Mn \leqq 2\%$$

$$0\% \leqq Ni \leqq 4\%$$

$$0\% \leqq Cr \leqq 3\%$$

$$0\% \leqq Mo \leqq 0.6\%$$

$$0\% \leqq W \leqq 1.2\%$$

optionally from 0.0005% to 0.005% of boron, optionally at least one element taken from Nb, V, Zr and Ti, each in amounts of less than 0.3%, optionally at least one element taken from Se, Te, Ca, Bi and Pb, each in amounts of less than 0.1%, the balance being iron and impurities resulting from smelting, the steel composition furthermore satisfying the following relationships:

$$0.6\% \leqq Al+Si \leqq 2\%$$

and $$4.6 \times C+1.05 \times Mn+0.54 \times Ni+0.66 \times (Mo+W/2)+0.5 \times Cr+K \geqq 1.6$$

where component weight percentages are used and where

K=0 if the steel contains less than 0.0005% of boron and

K=0.5 if the steel contains more than 0.0005% of boron.

Preferably, the chemical composition of the steel comprises:

$$0.24\% \leqq C \leqq 0.27\%$$

$$0\% \leqq Si \leqq 1\%$$

$$0\% \leqq Al \leqq 1\%$$

$$0.3\% \leqq Mn \leqq 1.6\%$$

$$0\% \leqq Ni \leqq 2\%$$

$$0.5\% \leqq Cr \leqq 1.8\%$$

the chemical composition furthermore satisfying the relationships:

$$0.15\% \leqq Mo+W/2 \leqq 0.45\%$$

and $$0.6\% \leqq Si+Al \leqq 1\%.$$

More preferably, the chemical composition of the invention steels may furthermore satisfy the relationship:

$$4.6 \times C+1.05 \times Mn+0.54 \times Ni+0.66 \times (Mo+W/2)+0.5 \times Cr+K \leqq 3.7$$

where

K=0 if the steel contains less than 0.0005% of boron and

K=0.5 if the steel contains more than 0.0005% of boron.

The invention also relates to a process for manufacturing a component made of steel having high abrasion resistance, in which:

steel in accordance with the invention is austenized by heating above $Ac_3$ and then cooled down to room temperature in such a way that, at every point in the steel, the cooling rate between the austenization temperature and 450° C. is greater than 1° C./s and the time to go from a temperature of 450° C. to a temperature of 200° C. is between 50 s and 60 min, preferably between 100 s and 30 min, optionally, an anneal is carried out at a temperature of less than 250° C. for a time of less than 3 hours.

In order to cool the steel down to room temperature from the austenization temperature, the component may, for example, be oil-quenched. This is especially the case when the component is a sheet having a thickness of between 10 mm and 100 mm.

In order to cool the component down to room temperature from the austenization temperature, the component may, for example, also be air-quenched. This is especially the case when the component is a sheet having a thickness of between 2 mm and 20 mm.

Finally, the invention relates to an abrasion-resistant component comprising the steel according to the invention, having a martensitic or martensito-bainitic structure containing between 5% and 15% of austenite and having a hardness of between 400 HB and 500 HB.

The steel in accordance with the invention, or the devices, components, etc., manufactured by the process in accordance with the invention, may be used for the manufacture of, or are, wearing components for equipment especially intended to be used in the working of quarries and mines, in civil engineering works, in cement works, in steelworks, in tile works, in brickworks, in agriculture, etc. Such articles of manufacture are herein referred to as devices intended to be subjected to abrasion. These articles may only comprise the invention steel or be wholly made therefrom.

DESCRIPTION OF THE PREFERRED EMBODIMENTS

The invention will now be described in more detail, but in a non-limiting manner. All weights are based on total weight of steel unless otherwise indicated.

The steel according to the invention preferably contains, by weight:

- more than 0.24% of carbon in order to make it possible to obtain a sufficient hardness, necessary for good abrasion resistance, but less than 0.3%, and preferably less than 0.27%, in order to obtain good weldability, good cutability, good bendability and satisfactory toughness;
- from 0% to 2% of silicon and from 0% to 2% of aluminum, the sum of the aluminum and silicon contents being greater than or equal to 0.6% in order to slow down the precipitation of carbides during the heat treatment, but less than or equal to 2%, and preferably less than or equal to 1%, so that the steel is easier to smelt and its toughness does not deteriorate;
- from 0% to 2%, and preferably from 0.3% to 1.6%, of manganese, from 0% to 4%, and preferably from 0% to 2% of nickel, from 0% to 3%, and preferably from 0.5% to 1.8%, of chromium, from 0% to 0.6% of molybdenum, from 0% to 1.2% of tungsten, the sum of the molybdenum content and half the tungsten content preferably being between 0.15% and 0.45% so as to obtain sufficient but not excessive hardenability, in order to make it possible to obtain mainly a martensitic or martensito-bainitic structure containing an appreciable proportion of retained austenite, the chromium, molybdenum and tungsten having, in addition, the advantage of allowing the formation of carbides favorable to abrasion resistance;
- optionally, from 0.0005% to 0.005% of boron in order to adjust the hardenability;
- optionally, at least one element taken from Nb, V, Zr and Ti in order to obtain precipitation hardening which does not cause deterioration of the weldability;
- optionally, at least one element taken from Se, Te, Ca, Bi and Pb in order to improve the machinability;
- the balance being iron and impurities resulting from the smelting.

In order for the hardenability to be sufficient, it is preferable that the chemical composition of the steel satisfy the relationship:

$$A=4.6\times C+1.05\times Mn+0.54\times Ni+0.66\times(Mo+W/2)+0.5\times Cr+K\geqq 1.6$$

where

K=0 if the steel contains less than 0.0005% of boron with

K=0.5 if the steel contains more than 0.0005% of boron.

However, in order for the hardenability not to be excessive, in order not to cause deterioration of its ability to be processed, especially by welding or by thermal cutting, it is also preferable that A remain less than or equal to 3.7.

Because of its relatively low carbon content, the invention steel has good weldability and good suitability for cutting by thermal means, and its abrasion resistance depends on its micrographic structure and therefore on the heat treatment to which it is subjected.

The inventors have observed that when the invention steel has a structure mainly consisting of martensite or of a mixture of martensite and bainite (martensito-bainitic structure) and from 5% to 15% of retained carbon-rich austenite, so as to have a hardness of between 450 HB and 500 HB, its abrasion resistance was very comparable to that of martensitic steels of hardness greater than 550 HB and its suitability for cold forming by plastic deformation was appreciably superior. The good abrasion resistance is believed to result from the fact that, under the action of abrasive particles, the retained austenite is locally transformed into very hard martensite, while at the same time benefiting from the ability of the stressed metal to deform significantly. Furthermore, the presence of a fine dispersion of chromium and molybdenum carbides in the martensitic constituent improves the wear behavior.

The inventors have also observed that the above-described structure is provided when the steel of the invention is austenized by heating above $Ac_3$ and then cooling down to room temperature in such a way that the cooling rate between the austenization temperature and 450° C. is greater than 1° C./s and the time to go from a temperature of 450° C. to a temperature of 200° C. is between 50 s and 60 min, and preferably between 100 s and 30 min. This heat treatment may, optionally, be completed by an anneal at a temperature of less than 250° C. for a time of less than 3 hours.

In order to manufacture an abrasion-resistant component, a steel according to the invention is smelted and cast in the form of a semi-finished product which is then shaped by hot plastic deformation, for example by rolling or by forging. The component thus obtained is then austenized by heating above $Ac_3$ and then cooled down to room temperature in such a way that, at every point, the cooling rate between the austenization temperature and 450° C. is greater than 1° C./s and the time to go from the temperature of 450° C. to the temperature of 200° C. is between 50 s and 60 min, and preferably between 100 s and 30 min. Optionally, the component is subjected to an anneal at a temperature of less than 250° C. for a time of less than 3 hours.

Passing through the 450° C./200° C. range at a slow rate is believed to have the effect of allowing retention of metastable austenite while at the same time favoring the formation of fine chromium and molybdenum carbides distributed homogeneously in the martensitic or martensito-bainitic constituent.

In order to cool the component down to room temperature from the austenization temperature, it is possible to oil-quench the component when its massiveness is appropriate. This is especially the case when the component is a sheet having a thickness of between 10 mm and 100 mm.

Likewise, in order to cool the component down to room temperature from the austenization temperature, it is also possible to air-quench the component when its massiveness is appropriate. This is especially the case when the component is a sheet having a thickness of between 2 mm and 20 mm.

An abrasion resistant component, and especially a sheet, is thus obtained which consists of steel according to the invention having a martensitic or martensito-bainitic structure containing between 5% and 15% of austenite and having a hardness of between 400 HB and 500 HB.

EXAMPLES

By way of example, sheets were manufactured with steels A and B in accordance with the invention and with steels C and D according to the prior art.

The compositions of these steels were: in thousandths of % by weight:

| | C | Si | Al | Mn | Ni | Cr | Mo | B |
|---|---|---|---|---|---|---|---|---|
| A | 247 | 817 | 63 | 1290 | 495 | 726 | 328 | 2.8 |
| B | 251 | 263 | 704 | 1305 | 439 | 715 | 342 | 2.6 |
| C | 254 | 310 | 65 | 1329 | 445 | 702 | 351 | 2.6 |
| D | 415 | 307 | 62 | 1285 | 293 | 712 | 349 | 2.7 |

The properties of sheets TA1, TA2 and TB, prepared in accordance with the invention, and sheets TA3, TC and TD, which are given by way of comparison, were:

| Sheet | Steel | Thickness mm | Austenization °C. | Quench | Anneal °C. | Post-treatment hardness HB | Hardness under abraded layer HB | Abrasion withstand index |
|---|---|---|---|---|---|---|---|---|
| TA1 | A | 35 | 900 | oil | 200 | 463 | 525 | 97 |
| TA2 | A | 5 | 900 | air | 200 | 455 | 526 | 105 |
| TB | B | 35 | 900 | oil | 200 | 466 | 529 | 102 |
| TA3 | A | 35 | 900 | water | 200 | 476 | 492 | 70 |
| TC | C | 35 | 900 | oil | 200 | 468 | 495 | 79 |
| TD | D | 35 | 900 | water | 200 | 552 | 561 | 100 |

Sheet TD, in accordance with the prior art, has an entirely martensitic structure, a hardness of greater than 550 HB and an abrasion resistance index of 100; however, because of the carbon content of the steel, the sheet is difficult to weld.

Sheet TA3, consisting of steel according to the invention, was water-quenched, which imparted to it a structure different from that which is required by the invention, and it has an abrasion resistance index of 70, substantially less than those of sheets TA1, TA2 and TB in accordance with the invention, which are comparable to that of reference sheet TD.

Sheets TA1 and TB are also distinguished from sheet TD by their bendability; sheets TA1 and TB may be bent to a radius equal to 6 times the thickness while sheet TD cannot be bent to a radius of less than 15 times the thickness.

Because of their properties, the components in general, and the sheets in particular, in accordance with the invention, are particularly suitable for the manufacture of any type of device intended to be subjected to abrasion or component for such a device and are incorporated, especially, in equipment for the handling of loose products in every type of industry. By way of example, these components may be cutting blades and reinforcing runners under the plates of loader/conveyor buckets or scoops, guide-chain plates of excavators and draglines, cog racks, driving crowns, chain wheels, side casing plates of impact grinding mills or jaw crushers, screen grids for use in civil engineering works and in working quarries or gravel pits; bottoms and scrapers of scraper-chain conveyors, casing plates of hoppers or of chutes, scale plates of spiral chutes, desludger combs, blades of classifiers, components of breaking or transporting machinery, skirts of cyclones for working coal mines or other mines; casing plates of hoppers or skips, plates of grab buckets, bottoms of coke-cars, vibrating extractors, casing plates of shot-peening chambers, guiding or sliding plates in steel making; cutter blades of breakers, blades and bottoms of grinder-type extruders, molds, components of turbo-disintegrators, metering hoppers for tile works or brickworks, tools and teeth for loosening or tree-stump removal, timber clamps, cutters, choppers, beaters, hammers, smoothing plates, components of land-clearing or stone-removing machinery, longitudinal members of timber lorries, teeth of subsoilers, stubble-ploughing flails for agriculture or for the working of soils, etc.

This application is based on French patent application 95 05016, filed Apr. 27, 1995, incorporated herein by reference.

What is claimed as new and desired to be secured by Letters Patent of the United States is:

1. A steel composition comprising, by weight based on total weight:

$$0.24\% \leqq C \leqq 0.27\%$$

$$0\% \leqq Si \leqq 1\%$$

$$0\% \leqq Al \leqq 1\%$$

$$0.3\% \leqq Mn \leqq 1.6\%$$

$$0\% \leqq Ni \leqq 2\%$$

$$0.5\% \leqq Cr \leqq 1.8\%$$

$$0\% \leqq Mo \leqq 0.6\%$$

$$0\% \leqq W \leqq 1.2\%$$

optionally from 0.0005% to 0.005% of boron, optionally at least one element taken from Nb, V, Zr and Ti, each in amounts of less than 0.3%, optionally at least one element taken from Se, Te, Ca, Bi and Pb, each in amounts of less than 0.1%, the balance being iron and impurities resulting from smelting, the composition furthermore satisfying the following relationships:

$$0.15\% < Mo+W/2 < 0.45\%;$$

$$0.6\% \leqq Al+Si \leqq 1\%$$

and $$4.6 \times C+1.05 \times Mn+0.54 \times Ni+0.66 \times (Mo+W/2)+0.5 \times Cr+K \geqq 1.6$$

where

K=0 if the steel contains less than 0.0005% of boron or

K=0.5 if the steel contains more than 0.0005% of boron.

2. The steel as claimed in claim 1, wherein the composition furthermore satisfies the relationship:

$$4.6 \times C+1.05 \times Mn+0.54 \times Ni+0.66 \times (Mo+W/2)+0.5 \times Cr+K \leqq 3.7$$

where

K=0 if the steel contains less than 0.0005% of boron or

K=0.5 if the steel contains more than 0.0005% of boron.

3. A process for manufacturing an article made of steel comprising the steps of:

providing a steel composition comprising, by weight based on total weight:

$$0.24\% \leqq C \leqq 0.3\%$$

$$0\% \leqq Si \leqq 2\%$$

$$0\% \leqq Al \leqq 2\%$$

$$0\% \leqq Mn \leqq 2\%$$

$$0\% \leqq Ni \leqq 4\%$$

$$0\% \leqq Cr \leqq 3\%$$

$$0\% \leqq Mo \leqq 0.6\%$$

$$0\% \leqq W \leqq 1.2\%$$

optionally from 0.0005% to 0.005% of boron, optionally at least one element taken from Nb, V, Zr and Ti, each in amounts of less than 0.3%, optionally at least one element taken from Se, Te, Ca, Bi and Pb, each in amounts of less than 0.1%, the balance being iron and impurities resulting from smelting, the composition furthermore satisfying the following relationships:

$$0.6\% \leqq Al+Si \leqq 2\%$$

and $$4.6\times C+1.05\times Mn+0.54\times Ni+0.66\times(Mo+W/2)+0.5\times Cr+K \geqq 1.6$$

where

K=0 if the steel contains less than 0.0005% of boron or

K=0.5 if the steel contains more than 0.0005% of boron, austenitizing the steel composition by heating above $Ac_3$ and then cooling down to room temperature in such a way that, at every point in the composition, the cooling rate between the austenitizing temperature and 450° C. is greater than 1° C./s and the time to go from a temperature of 450° C. to a temperature of 200° C. is between 50 s and 60 min, optionally, annealing the austenitized steel composition at a temperature of less than 250° C. for a time of less than 3 hours.

4. The process as claimed in claim 3, wherein, in order to cool the steel composition down to room temperature from the austenitization temperature, the component is oil-quenched.

5. The process as claimed in claim 4, wherein the steel composition is in the form of a sheet having a thickness of between 10 mm and 100 mm.

6. The process as claimed in claim 3, wherein, in order to cool the steel composition down to room temperature from the austenitization temperature, the component is air-quenched.

7. The process as claimed in claim 6, wherein the steel composition is in the form of a sheet having a thickness of between 2 mm and 20 mm.

8. A device intended to be subjected to abrasion, or a component of said device, comprising a steel composition which composition comprises, by weight based on total weight:

$$0.24\% \leqq C \leqq 0.27\%$$

$$0\% \leqq Si \leqq 1\%$$

$$0\% \leqq Al \leqq 1\%$$

$$0.3\% \leqq Mn \leqq 1.6\%$$

$$0\% \leqq Ni \leqq 2\%$$

$$0.5\% \leqq Cr \leqq 1.8\%$$

$$0\% \leqq Mo \leqq 0.6\%$$

$$0\% \leqq W \leqq 1.2\%$$

optionally from 0.0005% to 0.005% of boron, optionally at least one element taken from Nb, V, Zr and Ti, each in mounts of less than 0.3%, optionally at least one element taken from Se, Te, Ca, Bi and Pb, each in moats of less than 0.1%, the balance being iron and impurities resulting from smelting, the composition furthermore satisfying the following relationships:

$$0.15\% < Mo+W/2 < 0.45\%;$$

$$0.6\% \leqq Al+Si \leqq 1\%$$

and $$4.6\times C+1.05\times Mn+0.54\times Ni+0.66\times(Mo+W/2)+0.5\times Cr+K \geqq 1.6$$

where

K=0 if the steel contains less than 0.0005% of boron or

K=0.5 if the steel contains more than 0.0005% of boron, and wherein said steel composition has a martensitic or martensitic-bainitic structure containing between 5% and 15% of austenite and having a hardness of between 400 HB and 500 HB.

9. The process as claimed in claim 3, wherein said steel has a composition comprising, by weight based on total weight:

$$0.24\% \leqq C \leqq 0.27\%$$

$$0\% \leqq Si \leqq 1\%$$

$$0\% \leqq Al \leqq 1\%$$

$$0.3\% \leqq Mn \leqq 1.6\%$$

$$0\% \leqq Ni \leqq 2\%$$

$$0.5\% \leqq Cr \leqq 1.8\%$$

$$0\% \leqq Mo \leqq 0.6\%$$

$$0\% \leqq W \leqq 1.2\%$$

optionally from 0.0005% to 0.005% of boron, optionally at least one element taken from Nb, V, Zr and Ti, each in amounts of less than 0.3%, optionally at least one element taken from Se, Te, Ca, Bi and Pb, each in amounts of less than 0.1%, the balance being iron and impurities resulting from smelting, the composition furthermore satisfying the following relationships:

$$0.15\% < Mo+W/2 < 0.45\%;$$

$$0.6\% \leqq Al+Si \leqq 1\%$$

and $$4.6\times C+1.05\times Mn+0.54\times Ni+0.66\times(Mo+W/2)+0.5\times Cr+K \geqq 1.6$$

where

K=0 if the steel contains less than 0.0005% of boron or

K=0.5 if the steel contains more than 0.0005% of boron.

10. The process as claimed in claim 9, wherein, in order to cool the steel composition down to room temperature from the austenitization temperature, the component is oil-quenched.

11. The process as claimed in claim 10, wherein, the steel composition is in the form of a sheet having a thickness of between 10 mm and 100 mm.

12. The process as claimed in claim 9, wherein, in order to cool the steel composition down to room temperature from the austenitization temperature, the component is air-quenched.

13. The process as claimed in claim 12, wherein the steel composition in the form of a sheet having a thickness of between 2 mm and 20 mm.

14. The steel as claimed in claim 1 wherein said steel has a martensitic or martensitic-bainitic structure containing between 5% and 15% of austenite and having a hardness of between 400 HB and 500 HB.

* * * * *